US006300752B1

(12) United States Patent
Mack

(10) Patent No.: US 6,300,752 B1
(45) Date of Patent: Oct. 9, 2001

(54) COMMON MODE BIAS VOLTAGE GENERATOR

(75) Inventor: Michael Peter Mack, San Francisco, CA (US)

(73) Assignee: Level One Communications, Inc., Sacramento, CA (US)

( * ) Notice: Subject to any disclaimer, the term of this patent is extended or adjusted under 35 U.S.C. 154(b) by 0 days.

(21) Appl. No.: 09/558,915

(22) Filed: Apr. 26, 2000

Related U.S. Application Data

(60) Provisional application No. 60/135,570, filed on May 24, 1999.

(51) Int. Cl.[7] ..... G05F 3/16

(52) U.S. Cl. ..... 323/313; 327/530

(58) Field of Search ..... 323/312, 313, 323/315; 327/530, 534, 535, 537, 538, 541

(56) References Cited

U.S. PATENT DOCUMENTS

| | | | | |
|---|---|---|---|---|
| 5,218,238 | * | 6/1993 | Nonaka et al. | 307/296.1 |
| 5,654,663 | * | 8/1997 | McClure et al. | 327/530 |
| 5,808,515 | * | 9/1998 | Tsuruoka et al. | 330/277 |
| 5,963,057 | * | 10/1999 | Schmitt et al. | 326/103 |
| 6,008,632 | * | 12/1999 | Sasaki | 323/313 |

* cited by examiner

*Primary Examiner*—Matthew Nguyen
(74) *Attorney, Agent, or Firm*—Merchant & Gould P.C.

(57) ABSTRACT

A common mode bias voltage generator apparatus and method includes a plurality of MOSFET-based transistors and a plurality of resistors configured and arranged to provide a half of a supply voltage with a predetermined low output impedance while using relatively little power and circuit area.

6 Claims, 2 Drawing Sheets

COMMON MODE BIAS VOLTAGE GENERATOR

RELATED APPLICATION

This application claims the benefit of Provisional Application, U.S. Ser. No. 60/135,570, filed on May 24, 1999, entitled "COMMON MODE BIAS VOLTAGE GENERATOR", by Michael P. Mack.

BACKGROUND OF THE INVENTION

1. Field of the Invention

This invention relates in general to signal processing devices in telecommunication systems, and more particularly to a common mode bias voltage generator apparatus and method used in signal processing devices.

2. Description of Related Art

In many signal processing devices, such as a switched capacitor circuit, it is often necessary to generate bias voltages proportional to a supply voltage VCC or VDD. For example, to maximize a dynamic range of a differential amplifier, it may be desirable to generate a VCC/2 (or VDD/2) bias voltage to use as a common mode output reference.

Common mode bias voltages can be generated with many circuits. One circuit to generate a common mode bias voltage is a capacitively bypassed resistor divider. However, a simple resistor divider may not provide the best trade off of power dissipation and circuit area to meet the output impedance, settling time, and/or noise performance required for an intended or required use of a common mode bias voltage generator.

A simple resistor divider generally includes a couple of resistors serially connected to each other. To provide required power output, the output impedance of a resistor divider is often much higher, thereby significantly affects the settling time and noise performance of the entire system. To reduce the output impedance, a simple resistor divider is often buffered with a full-blown power amplifier to obtain required output power. This type of bias voltage generator may require an additional off-chip power amplifier. If a power amplifier is built on-chip, it would increase the size of the chip design and may be difficult to design in high speed applications. Further, this type of bias voltage generator is not the best trade, off of power dissipation and circuit area to meet the output impedance, settling time, and/or noise performance, etc.

In a switched capacitor circuit, a transient switch is often modeled as a resistor with a particular value. To obtain a better settling time and/or noise performance, it is generally desired to have a common mode bias voltage proportional to a supply voltage with a lower output impedance while using relatively little power and circuit area.

It is with respect to these and other considerations that the present invention has been made.

SUMMARY OF THE INVENTION

To overcome the limitations in the prior art described above, and to overcome other limitations that will become apparent upon reading and understanding the present specification, the present invention discloses a common mode bias voltage generator apparatus and method.

The present invention solves the above-described problems by providing a common mode bias voltage generator apparatus and method which allow to generate bias voltages proportional to a supply voltage with a low output impedance while using relatively little power and circuit area.

One embodiment of the common mode bias voltage generator apparatus, in accordance with the principles of the present invention, includes a plurality of transistors and a plurality of resistors configured and arranged to provide a half of a supply voltage with a low output impedance and a predetermined power requirement.

Still in one embodiment, the apparatus includes first, second, third, fourth, fifth, sixth transistors, first, second, and third resistors, wherein the first resistor and the first transistor are serially connected between a supply voltage and ground, the first resistor is coupled between the supply voltage and a drain of the first transistor, the drain and a gate of the first transistor are coupled to each other, a source of the first transistor is coupled to the ground, and the second resistor is coupled in parallel to the first transistor.

Further in one embodiment, the second and third transistors are serially connected between the supply voltage and the ground. A drain of the third transistor is coupled to a drain of the second transistor and to a gate of the third transistor. A source of the third transistor is coupled to the supply voltage. A source of the second transistor is coupled to the ground, and a gate of the second transistor is coupled to the gate of the first transistor.

Additional in one embodiment, the fourth transistor and the sixth transistor are serially coupled between the supply voltage and the ground. A source of the fourth transistor is coupled to the supply voltage, and a source of the sixth transistor is coupled to the ground. A drain of the fourth transistor and a drain of the sixth transistor are coupled to each other and are coupled to an output port of the apparatus. A gate of the fourth transistor is coupled to the gate of the third transistor. A gate of the sixth Further in one embodiment, the third resistor and the fifth transistor are coupled between the output port and the ground. The third resistor is coupled between the output port and the drain of the fifth transistor. A gate of the fifth transistor is coupled to the gate of the second transistor. A source of the fifth transistor is coupled to the ground.

Still in one embodiment, a capacitor is coupled between the output port and the gate of the sixth transistor.

Yet in one embodiment, the first, second, fifth, and sixth transistors have the same gate-source voltage and the same drain current. The first and second resistors have the same resistance, and the third resistor has a half of the resistance of the first resistor. A drain current of the fourth transistor is twice of a drain current of the third transistor. An output voltage generated at the output port is a half of the supply voltage.

A method of generating a common mode bias voltage in accordance with the principles of the present invention includes providing a plurality of transistors, a plurality of resistors, and a supply voltage; and generating a half of the supply voltage with a predetermined output impedance and power requirement.

These and various other advantages and features of novelty which characterize the invention are pointed out with particularity in the claims annexed hereto and form a part hereof. However, for a better understanding of the invention, its advantages, and the objects obtained by its use, reference should be made to the drawings which form a further part hereof, and to accompanying descriptive matter, in which there are illustrated and described specific examples of an apparatus in accordance with the invention.

BRIEF DESCRIPTION OF THE DRAWINGS

Referring now to the drawings in which like reference numbers represent corresponding parts throughout.

DETAILED DESCRIPTION OF THE INVENTION

In the following description of the exemplary embodiment, reference is made to the accompanying drawings which form a part hereof, and in which it is shown by way of illustration the specific embodiment in which the invention may be practiced. It is to be understood that other embodiments may be utilized as structural changes may be made without departing from the scope of the present invention.

The present invention provides a common mode bias voltage generator apparatus and method which allow to generate bias voltages proportional to a supply voltage with a low output impedance while using relatively little power and circuit area. In one embodiment of the present invention shown in FIG. 3, the common mode bias voltage generator apparatus includes a circuit having a plurality of transistors and resistors configured and arranged to provide a half of a supply voltage with a predetermined output impedance while using relatively little power and circuit area.

Figure 1:
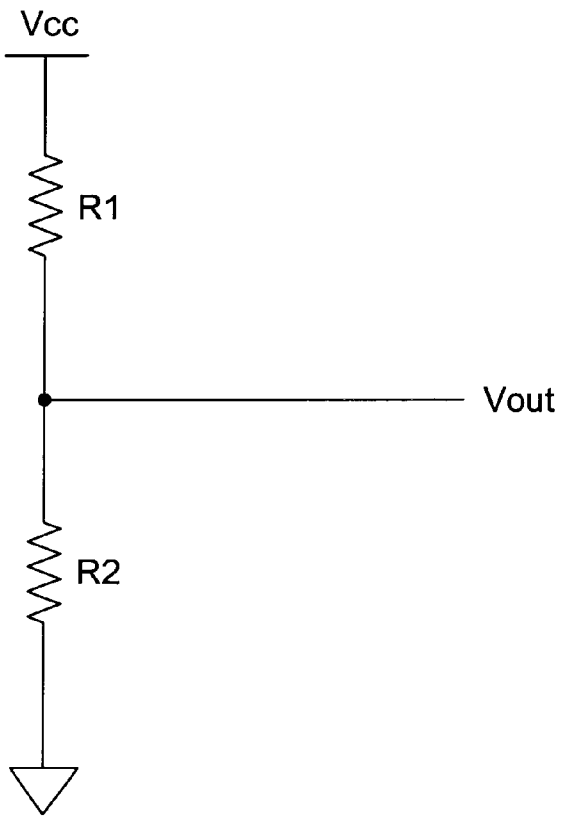
FIG. 1 (Prior Art)
FIG. 1 is a schematic diagram illustrating one typical common mode bias voltage generator using a capacitively bypassed resistor divider.

FIG. 1 illustrates one typical common mode bias voltage generator using a capacitively bypassed resistor divider. An output voltage VOUT is proportional to a supply voltage VCC. R1 and R2 divide the supply voltage VCC such that the output voltage VOUT is VCC*R2/(R1+R2). The output impedance is R2*R1/(R2+R1). To obtain a better trade off of power dissipation and circuit area, the output impedance is increased accordingly.

Figure 2:
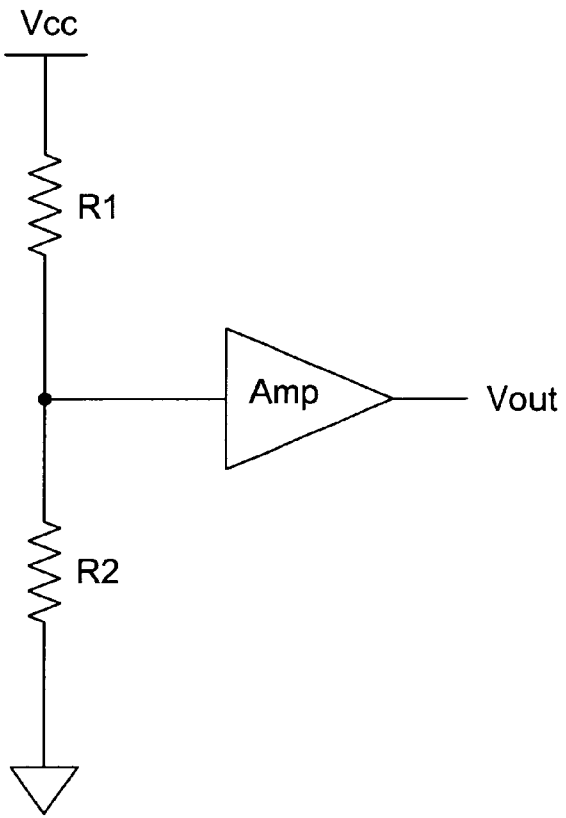
FIG. 2 (Prior Art)
FIG. 2 is a schematic diagram illustrating another typical common mode bias voltage generator using a capacitively bypassed resistor divider.

To meet the noise and/or other circuit performance requirement, a lower output impedance while using relatively little power and circuit area is desired. FIG. 2 illustrates an improved typical common mode bias voltage generator circuit. As shown in FIG. 2, the output from the resistor divider is buffered with an amplifier, AMP. The values of the resistors R1, R2 and the gain of the amplifier can be set such that an output impedance from the amplifier is lower while maintaining a required output power. In this method, an amplifier must be added. This type of bias voltage generator circuit may require an off-chip power amplifier. If a power amplifier is built on-chip, it would increase the size of the chip design and may be difficult to design in high speed applications. Further, this type of bias voltage generator circuit is not the best trade off of power dissipation and circuit area to meet the output impedance, settling time, and/or noise performance, etc.

Figure 3:
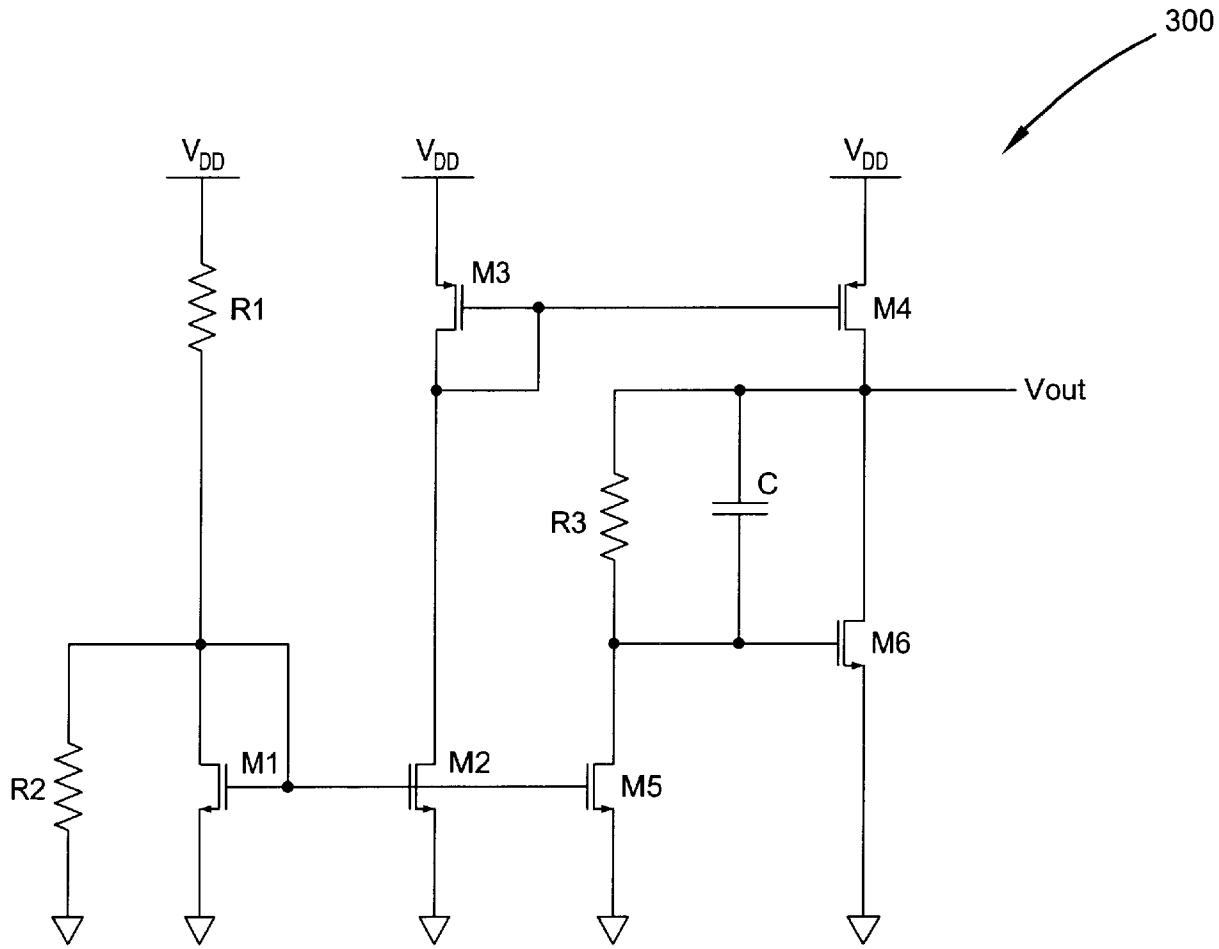
FIG. 3 is a schematic diagram illustrating one embodiment of a common mode bias voltage generator in accordance with the principles of the present invention.

FIG. 3 is a schematic diagram illustrating one embodiment of a common mode bias voltage generator 300 in accordance with the principles of the present invention. As shown, the voltage generator 300 is a MOSFET-based transistor circuit, for example, CMOS or NMOS or PMOS, etc. It is appreciated that the other types of suitable transistors can be used within the scope of the present invention. For example, a person skilled in the art would appreciate that a bi-polar-based transistor circuit can be used with suitable parameters.

In FIG. 3, the voltage generator 300 includes first, second, third, fourth, fifth, sixth transistors M1–M6 and first, second, and third resistors R1–R3. The first resistor R1 and the first transistor M1 are serially connected between a supply voltage VDD and ground. The first resistor R1 is coupled between the supply voltage VDD and a drain of the first transistor M1. The drain and a gate of the first transistor M1 are coupled to each other. A source of the first transistor M1 is coupled to the ground. The second resistor R2 is coupled in parallel to the first transistor M1.

The second and third transistors M2, M3 are serially connected between the supply voltage VDD and the ground. A drain of the third transistor M3 is coupled to a drain of the second transistor M2 and to a gate of the third transistor M3. A source of the third transistor M3 is coupled to the supply voltage VDD. A source of the second transistor M2 is coupled to the ground, and a gate of the second transistor M2 is coupled to the gate of the first transistor M1.

The fourth transistor M4 and the sixth transistor M6 are serially coupled between the supply voltage VDD and the ground. A source of the fourth transistor M4 is coupled to the supply voltage VDD. A source of the sixth transistor is coupled to the ground. A drain of the fourth transistor M4 and a drain of the sixth transistor M6 are coupled to each other and are coupled to an output port Vout of the voltage generator 300. A gate of the fourth transistor M4 is coupled to the gate of the third transistor M3. A gate of the sixth transistor M6 is coupled to a drain of the fifth transistor M5.

The third resistor R3 and the fifth transistor M5 are coupled between the output port Vout and the ground. The third resistor R3 is coupled between the output port Vout and the drain of the fifth transistor M5. A gate of the fifth transistor M5 is coupled to the gate of the second transistor M2. A source of the fifth transistor M5 is coupled to the ground.

A capacitor C is coupled between the output port Vout and the gate of the sixth transistor M6.

The first, second, fifth, and sixth transistors M1, M2, M5, M6 have the same gate-source voltage, Vgs, and the same drain current I1. The first and second resistors R1, R2 have the same value R, and the third resistor R3 has a half of the resistance, R/2, of the first resistor R1. A drain current I4 of the fourth transistor M4 is twice of a drain current I1 of the third transistor M3. An output voltage VOUT generated at the output port Vout is a half of the supply voltage, VDD/2.

The operation of the voltage generator 300 is described below. Since resistors R1 and R2 are identical with a value R, this causes a current I1 which is equal to VDD/R−Vgs/(2*R) to flow in the first transistor M1. Since the third and fourth transistors, M3 and M4, are designed such that the drain current of the fourth transistor M4 is twice that of the third transistor M3, the sixth transistor M6 is forced to have the same drain current I1 as the first transistor M1. Also, since the sixth transistor M6 is identical to the first, second, and fifth transistors, M1, M2, and M5, the DC output voltage VOUT is the sum of Vgs and the voltage across the third resistor R3. Since the value of the third resistor R3 is a half of the value of the first resistor R1, the output voltage VOUT is VDD/2.

The above calculations can be shown as follows:

$$I1=(VDD-Vgs)/R1-Vgs/R2=VDD/R-2Vgs/R$$

$$Vout=V3+Vgs=R3*I3+Vgs=R/2*(VDD/R-2Vgs/R)+Vgs=VDD/2$$

The voltage generator circuit 300 has the advantage of having a low output impedance while using relatively little power and circuit area. The DC output impedance of the circuit 300 is simply 1/gm (gm is the transconductance) of the sixth transistor M6. The value of gm can be selected such that the output impedance of the circuit 300 is set to a predetermined low value. For example, with the circuit 300, an output impedance of less than 1k ohm can be achieved with a fraction of the power that would be required to get the same output impedance from a resistor divider.

The foregoing description of the exemplary embodiment of the invention has been presented for the purposes of illustration and description. It is not intended to be exhaustive or to limit the invention to the precise form disclosed. Many modifications and variations are possible in light of the above teaching. It is intended that the scope of the invention be limited not with this detailed description, but rather by the claims appended hereto.

What is claimed is:

1. A common mode bias voltage generator apparatus, comprising:

a supply voltage;

a plurality of MOSFET-based transistors and a plurality of resistors configured and arranged to provide a half of the supply voltage with a predetermined output impedance and power requirement;

wherein the plurality of transistors and resistors include first, second, third, fourth, fifth, sixth transistors, first, second, and third resistors; and wherein the first, second, fifth, and sixth transistors have the same gate-source voltage and the same drain current, the first and second resistors have the same resistance, the third resistor has a half of the resistance of the first resistor, a drain current of the fourth transistor is twice of a drain current of the third transistor.

2. The apparatus of claim 1, wherein the first resistor and the first transistor are serially connected between a supply voltage and ground, the first resistor is coupled between the supply voltage and a drain of the first transistor, the drain and a gate of the first transistor are coupled to each other, a source of the first transistor is coupled to the ground, and the second resistor is coupled in parallel to the first transistor.

3. The apparatus of claim 2, wherein the second and third transistors are serially connected between the supply voltage and the ground, a drain of the third transistor is coupled to a drain of the second transistor and to a gate of the third transistor, a source of the third transistor is coupled to the supply voltage, a source of the second transistor is coupled to the ground, and a gate of the second transistor is coupled to the gate of the first transistor.

4. The apparatus of claim 3, wherein the fourth transistor and the sixth transistor are serially coupled between the supply voltage and the ground, a source of the fourth transistor is coupled to the supply voltage, a source of the sixth transistor is coupled to the ground, a drain of the fourth transistor and a drain of the sixth transistor are coupled to each other and are coupled to an output port of the apparatus, a gate of the fourth transistor is coupled to the gate of the third transistor, and a gate of the sixth transistor is coupled to a drain of the fifth transistor.

5. The apparatus of claim 4, wherein the third resistor and the fifth transistor are coupled between the output port and the ground, the third resistor is coupled between the output port and the drain of the fifth transistor, a gate of the fifth transistor is coupled to the gate of the second transistor, and a source of the fifth transistor is coupled to the ground.

6. The apparatus of claim 5, wherein a capacitor is coupled between the output port and the gate of the sixth transistor.

* * * * *